US009113509B2

(12) United States Patent
Hasegawa et al.

(10) Patent No.: US 9,113,509 B2
(45) **Date of Patent: *Aug. 18, 2015**

(54) LIGHTING DEVICE AND LIGHTING FIXTURE

(71) Applicant: Panasonic Corporation, Osaka (JP)

(72) Inventors: Junichi Hasegawa, Osaka (JP); Hiroshi Kido, Osaka (JP); Akinori Hiramatu, Nara (JP); Takeshi Kamoi, Kyoto (JP); Shigeru Ido, Osaka (JP); Nobutoshi Matsuzaki, Osaka (JP); Daisuke Yamahara, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/176,217

(22) Filed: Feb. 10, 2014

(65) Prior Publication Data

US 2014/0225507 A1 Aug. 14, 2014

(30) Foreign Application Priority Data

Feb. 13, 2013 (JP) ..... 2013-025255

(51) Int. Cl.
*H01J 7/24* (2006.01)
*H05B 37/02* (2006.01)
*H05B 33/08* (2006.01)

(52) U.S. Cl.
CPC ..... *H05B 37/02* (2013.01); *H05B 33/0803* (2013.01)

(58) Field of Classification Search
CPC ..... H05B 37/02; H05B 37/0227; H05B 37/0218; H05B 37/029; H05B 33/0815; H05B 41/3925; H05B 41/36; H05B 33/0803; H01J 19/36; Y02B 20/46; Y02B 20/202
USPC ..... 315/112, 117, 118, 224, 291, 294, 307, 315/308, 312, 318
See application file for complete search history.

(56) References Cited

U.S. PATENT DOCUMENTS 7,213,940 B1 * 5/2007 Van De Ven et al. ..... 362/231
7,609,018 B2 * 10/2009 Lin et al. ..... 318/471

(Continued)

FOREIGN PATENT DOCUMENTS

JP 2001-043728 A 2/2001
JP 2010-086713 A 4/2010

(Continued)

OTHER PUBLICATIONS

Extended European Search Report, corresponding EP Application No. 14153897.5, dated Apr. 7, 2014.

*Primary Examiner* — Haissa Philogene
(74) *Attorney, Agent, or Firm* — Renner, Otto, Boisselle & Sklar, LLP

(57) ABSTRACT

The lighting device according to the present invention includes: a power source configured to supply power to a light source having a plurality of regions; a plurality of cooling devices arranged corresponding to the plurality of regions to cool the plurality of regions, respectively; and a cooling control circuit configured to control the plurality of cooling devices. The cooling control circuit includes: a plurality of output circuits configured to supply drive voltages to the plurality of cooling devices by use of power from the power source to drive the plurality of cooling devices, respectively; a plurality of temperature measurement circuits configured to respectively measure temperatures of the plurality of regions; and an output control circuit configured to regulate the drive voltages respectively supplied from the plurality of output circuits based on the temperatures respectively measured by the plurality of temperature measurement circuits.

13 Claims, 12 Drawing Sheets

(56) References Cited

U.S. PATENT DOCUMENTS

| | | | | |
|---|---|---|---|---|
| 8,070,324 | B2 * | 12/2011 | Kornitz et al. | 362/294 |
| 8,087,787 | B2 * | 1/2012 | Medin | 353/52 |
| 8,278,846 | B2 * | 10/2012 | Roberts et al. | 315/308 |
| 8,569,910 | B2 * | 10/2013 | Dunn et al. | 307/31 |
| 2010/0027276 | A1 | 2/2010 | Kornitz et al. | |
| 2012/0161633 | A1 | 6/2012 | Nishitani et al. | |

FOREIGN PATENT DOCUMENTS

| | | | |
|---|---|---|---|
| JP | 2010-192336 | A | 9/2010 |
| JP | 2010-192406 | A | 9/2010 |
| JP | 2011-150936 | A | 8/2011 |
| WO | WO 2009/033051 | A1 | 3/2009 |
| WO | WO 2010/099187 | A2 | 9/2010 |

* cited by examiner

FIG. 11

| FIRST DETECTION VOLTAGE | FIRST CONTROL DATA SET | SECOND DETECTION VOLTAGE | SECOND CONTROL DATA SET |
|---|---|---|---|
| 0 | A0 | 0 | A0 |
| 1 | A0 | 1 | A0 |
| ⋮ | ⋮ | ⋮ | ⋮ |
| 100 | A0 | 100 | A0 |
| 101 | A1 | 101 | B1 |
| ⋮ | ⋮ | ⋮ | ⋮ |
| 255 | A155 | 255 | B155 |

FIG. 12

| FIRST DETECTION VOLTAGE | FIRST CONTROL DATA SET | SECOND DETECTION VOLTAGE | SECOND CONTROL DATA SET |
|---|---|---|---|
| 0 | TA0 | 0 | TB0 |
| 1 | TA1 | 1 | TB1 |
| ⋮ | ⋮ | ⋮ | ⋮ |
| 255 | TA255 | 255 | TB255 |

LIGHTING DEVICE AND LIGHTING FIXTURE

TECHNICAL FIELD

The present invention relates to a lighting device and a lighting fixture using the same.

BACKGROUND ART

In the past, there has been proposed an LED lighting device including a driving circuit for a cooling device for cooling an LED used as a light source. For example, such an LED lighting device is disclosed in document 1 (JP 2011-150936 A).

The LED lighting device disclosed in this document 1 includes a DC power source, a series circuit connected to a plurality of LEDs, and a cooling device driver for dissipating heat generated by the LEDs. The cooling device driver is connected in parallel with at least one LED of the series circuit. Thus, a DC voltage developed across the LED of the series circuit is supplied to the cooling device driver.

Additionally, the cooling device driver is connected to a temperature detecting device which is, for example, a temperature detector such as a thermistor. This temperature detecting device measures a temperature of the LED, and provides a detection signal relating to the LED to the cooling device driver. The cooling device driver operates a fan motor according to the detection signal.

The aforementioned prior art uses one temperature detecting device. When a high power LED is employed as the light source, the light source tends to be large in size and therefore it is difficult to measure a temperature of the entire light source by use of one temperature detecting device. In this case, even if the light source is cooled based on the temperature measured, temperatures of some regions of the light source are different, and accordingly a light output thereof is likely to be unstable. Also, in this case, the LED is likely to have such a local temperature that exceeds an allowable operating temperature, and this would cause a great deterioration in luminous flux and a great decrease in lifetime, and in some cases, the light source is turned off.

SUMMARY OF INVENTION

In view of the above insufficiency, the present invention has aimed to propose a lighting device capable of reducing a difference in temperature in a light source to stabilize a light output, and a lighting fixture using the lighting device.

The lighting device of the first aspect in accordance with the present invention includes: a power source configured to supply power to a light source having a plurality of regions; a plurality of cooling devices arranged corresponding to the plurality of regions to cool the plurality of regions, respectively; and a cooling control circuit configured to control the plurality of cooling devices. The cooling control circuit includes: a plurality of output circuits; a plurality of temperature measurement circuits; and an output control circuit. The plurality of output circuits are configured to supply drive voltages to the plurality of cooling devices by use of power from the power source to drive the plurality of cooking devices, respectively. The plurality of temperature measurement circuits are configured to respectively measure temperatures of the plurality of regions. The output control circuit is configured to regulate the drive voltages to be respectively supplied from the plurality of output circuits based on the temperatures respectively measured by the plurality of temperature measurement circuits.

According to the lighting device of the second aspect in accordance with the present invention, in addition to the first aspect, the output control circuit is configured to control the plurality of output circuits so as to reduce a difference between two temperatures selected from the temperatures respectively measured by the plurality of temperature measurement circuits.

According to the lighting device of the third aspect in accordance with the present invention, in addition to the second aspect, the output control circuit is configured to control the output circuit corresponding to the temperature measurement circuit that has measured a higher one of the two temperatures.

According to the lighting device of the fourth aspect in accordance with the present invention, in addition to the third aspect, each of the plurality of cooling devices is configured to increase a cooling capacity thereof with an increase in the drive voltage supplied thereto. The output control circuit is configured to increase the drive voltage of the output circuit corresponding to the temperature measurement circuit that has measured the higher one of the two temperatures.

According to the lighting device of the fifth aspect in accordance with the present invention, in addition to any one of the first to fourth aspects, the cooling control circuit further includes a power supply circuit configured to output a constant voltage by use of power from the power source. The plurality of output circuits each are configured to receive the constant voltage from the power supply circuit as the power from the power source and generate the drive voltage by use of the constant voltage.

According to the lighting device of the sixth aspect in accordance with the present invention, in addition to the fifth aspect, the output control circuit is configured to, when determining that all the temperatures respectively measured by the plurality of temperature measurement circuits are not greater than a first temperature, regulate the drive voltages of the plurality of output circuits to a same voltage. The output control circuit is configured to, when determining that at least one of the temperatures respectively measured by the plurality of temperature measurement circuits is greater than the first temperature, regulate the drive voltages of the plurality of output circuits to different voltages.

According to the lighting device of the seventh aspect in accordance with the present invention, in addition to the fifth aspect, the output control circuit has a plurality of correspondence information pieces each defining a correspondence relation between the temperatures and the drive voltages. The output control circuit is configured to determine the drive voltages of the plurality of output circuits based on the temperatures respectively measured by the plurality of temperature measurement circuits by use of the plurality of correspondence information pieces. The plurality of correspondence information pieces have the same correspondence relation between the temperatures and the drive voltages with regard to a range of equal to or less than a first temperature, and have the different correspondence relations between the temperatures and the drive voltages with regard to a range of more than the first temperature.

According to the lighting device of the eighth aspect in accordance with the present invention, in addition to the fifth aspect, the output control circuit is configured to operate the plurality of output circuits singly in order.

According to the lighting device of the ninth aspect in accordance with the present invention, in addition to any one of the first to eighth aspects, the lighting device further includes a dimming circuit configured to dim the light source by regulating power supplied from the power source to the light source. The dimming circuit is configured to, when determining that at least one of the temperatures respectively measured by the plurality of temperature measurement circuits exceeds a second temperature, decrease the power supplied from the power source to the light source.

According to the lighting device of the tenth aspect in accordance with the present invention, in addition to any one of the first to ninth aspects, each of the plurality of temperature measurement circuits includes a thermosensitive device having a characteristic value varying with a temperature.

According to the lighting device of the eleventh aspect in accordance with the present invention, in addition to the tenth aspect, the thermosensitive device is an NTC thermistor, a PTC thermistor, or a CTR thermistor.

According to the lighting device of the twelfth aspect in accordance with the present invention, in addition to any one of the first to eleventh aspects, the light source is configured to light up when energized.

The lighting fixture of the thirteenth aspect in accordance with the present invention includes: a fixture body for holding a light source; and a lighting device of any one of the first to twelfth aspects, for controlling the light source.

BRIEF DESCRIPTION OF THE DRAWINGS

FIG. 11 is a diagram illustrating an example of a data table of the output control circuit of the second embodiment;

FIG. 12 is a diagram illustrating another example of the data table of the output control circuit of the second embodiment;

DESCRIPTION OF EMBODIMENTS

First Embodiment

The following explanation referring to drawings is made to a lighting device of the first embodiment in accordance with the present invention. Note that, in each embodiment, the expression "plurality of" means "two or more".

Figure 1:
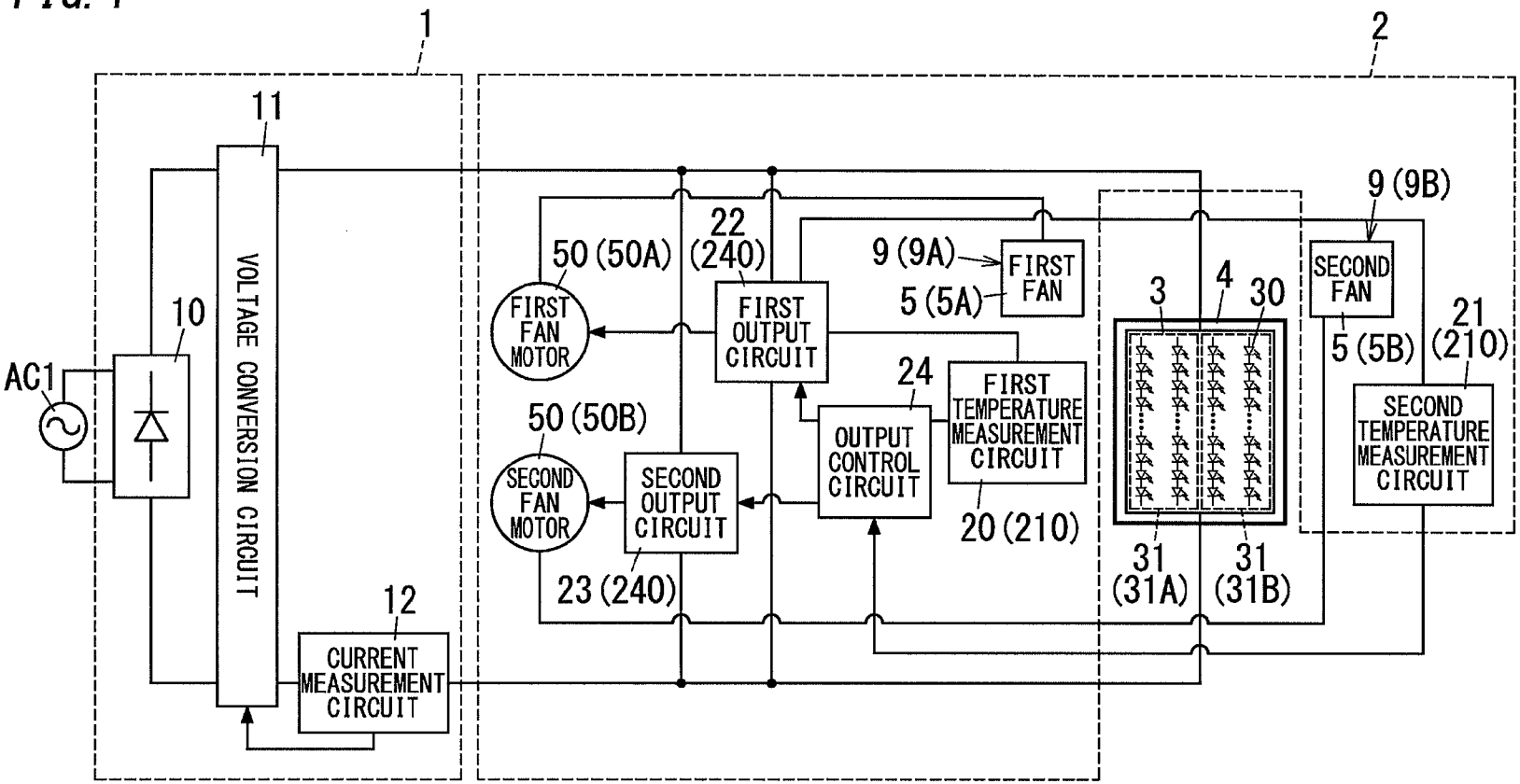
FIG. 1 is a schematic circuit diagram illustrating a lighting device of the first embodiment.
Figure 2:
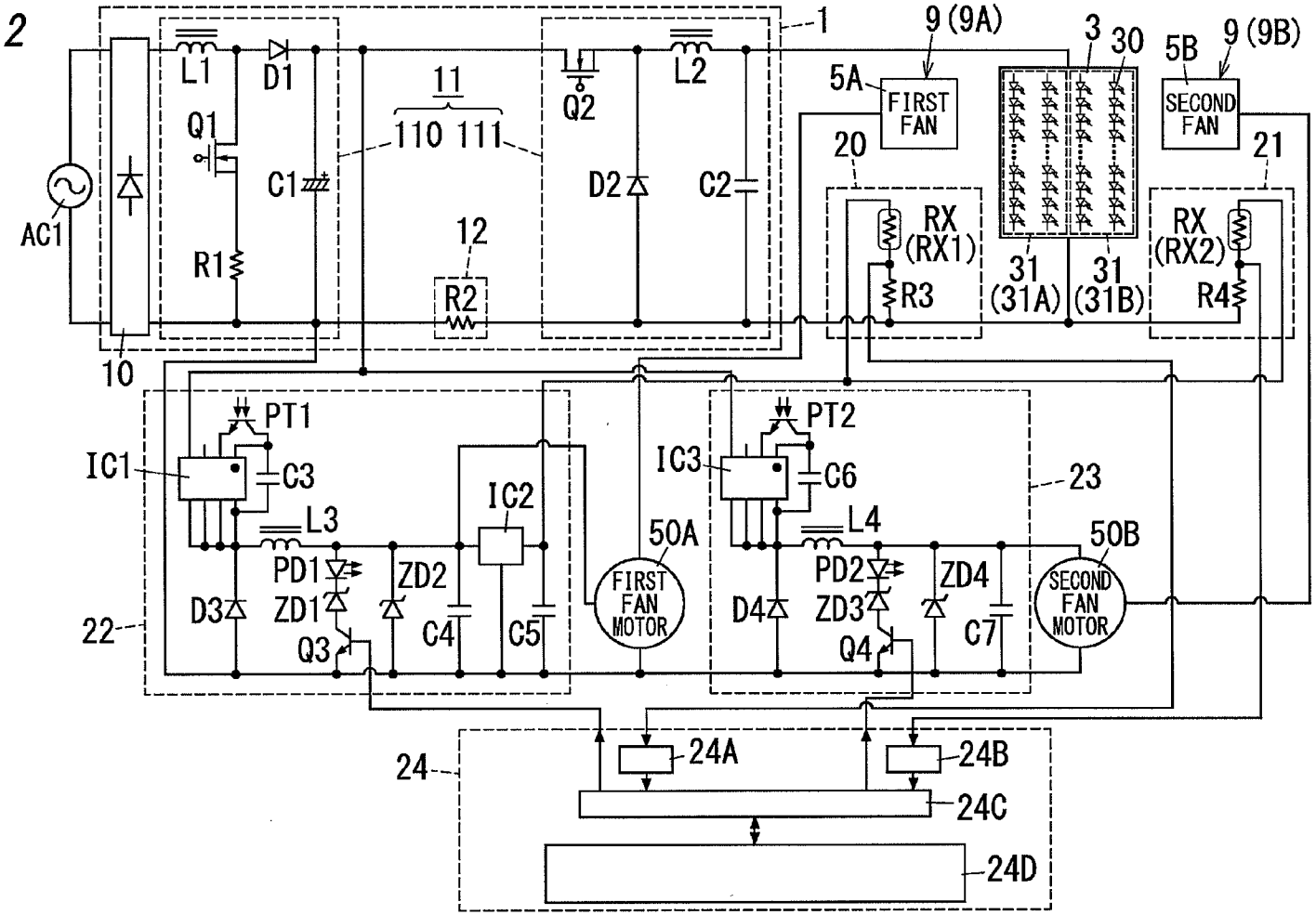
FIG. 2 is a concrete circuit diagram illustrating the lighting device of the first embodiment.

As shown in FIGS. 1 and 2, the lighting device of the present embodiment includes a power source (DC power source) 1 and a cooling control circuit 2.

The voltage source (DC voltage source) 1 supplies power to a light source 3. For example, the DC voltage source 1 is configured to convert AC power from a commercial AC power source AC1 into DC power and provide the resultant DC power. The DC voltage source 1 includes a rectifier 10, a voltage conversion circuit 11, and a current measurement circuit 12. Alternatively, the DC voltage source 1 may be configured to covert DC power from another DC power source into predetermined DC power (predetermined DC voltage) and provide the resultant DC power. Or, the DC voltage source 1 may be constituted by a battery (circuit including a battery).

The rectifier 10 is constituted by a diode bridge circuit, for example. The rectifier 10 is configured to perform full-wave rectification on an AC current from the commercial AC power source AC1 and thereby output a pulsating voltage.

As shown in FIG. 2, the voltage conversion circuit 11 includes a step-up chopper circuit (first circuit) 110 and a step-down chopper circuit (second circuit) 111.

The step-up chopper circuit (first circuit) 110 generates an output voltage which is constant. For example, the step-up chopper circuit 110 includes an inductor L1, a switching device Q1, a diode D1, a smoothing capacitor C1, and a resistor R1, and is used for improving a power factor. The resistor R1 is connected in series with the switching device Q1 to detect a current flowing through the switching device Q1. The step-up chopper circuit 110 regulates the output voltage to a constant voltage by turning on and off the switching device Q1 depending on the current detected by the resistor R1. Note that, the step-up chopper circuit 110 may be substituted with the smoothing capacitor C1 only.

The step-down chopper circuit (second circuit) 111 is configured to supply power to the light source 3 by use of the output voltage generated by the step-up chopper circuit 110. For example, the step-down chopper circuit 111 includes an inductor L2, a switching device Q2, a diode D2, and a smoothing capacitor C2. The step-down chopper circuit 111 is configured to decrease the output voltage from the step-up chopper circuit 110 and output the resultant voltage.

For example, the current measurement circuit 12 may be constituted by a resistor R2. The current measurement circuit 12 is configured to detect a load current flowing through the light source 3.

The step-down chopper circuit 111 regulates an output current or output power to be constant by turning on and off the switching device Q2 depending on the load currents detected by the current measurement circuit 12. Note that, the step-down chopper circuit 111 can be substituted with an isolated DC/DC converter such as a flyback converter.

The DC voltage source 1 supplies its output voltage to the light source 3. In brief, the DC voltage source 1 is a voltage source for supplying power to a light source 3 configured to light up when energized.

As shown in FIG. 2, the light source 3 is constituted by a plurality of LEDs 30 which are solid state light emitting devices and are connected in series, parallel, or series-parallel. Note that, the light source 3 may be constituted by a single solid state light emitting device. The light source 3 is connected between output ends of the DC power source 1. The light source 3 is turned on when currents flow through the LEDs 30 by applying the output voltage of the DC power source 1. To dim the light source 3, the output current of the DC power source 1 is varied to vary a current flowing through the LEDs 30.

Note that, a dimming circuit (not shown) may be interposed between the DC voltage source 1 and the light source 3. The output voltage of the DC power source 1 may be supplied to the light source 3 intermittently by performing PWM control on the output voltage of the DC power source 1 by use of the dimming circuit. The dimming circuit may merely have a function of dimming the light source 3 by varying the output of the DC voltage source 1. Such a dimming circuit is well known and an explanation thereof is omitted.

The light source 3 is mounted on a substrate 4 which has a high heat dissipation property and includes a base made of metal material. Note that, the substrate 4 is not limited to the substrate having a base made of metal material. The substrate 4 may have a base made of one of ceramic material and synthetic resin material which have fine heat dissipation properties and fine durability.

In the present embodiment, the light source 3 is mounted on the substrate 4 in a chip-on-board manner in which bare chips of the LEDs 30 of the light source 3 are directly mounted on the substrate 4. Note that, in the present embodiment, the bare chips of the LEDs 30 are mounted on the substrate 4 by bonding the bare chips of the LEDs 30 to the substrate 4 with adhesive such as silicone resin adhesive.

For example, the bare chip of the LED 30 is formed by disposing a light-emitting layer on a transparent or translucent sapphire substrate. The light-emitting layer is formed by stacking an n-type nitride semiconductor layer, an InGaN layer, and a p-type nitride semiconductor layer. The p-type nitride semiconductor layer is provided with a p-type electrode pad defining a positive electrode. The n-type nitride semiconductor layer is provided with an n-type electrode pad defining a negative electrode. These electrodes are electrically connected to electrodes on the substrate 4 via bonding wires made of metal material such as gold. In the present embodiment, the LED 30 combines light from an InGaN blue LED and light from yellow phosphor to produce white light.

In this regard, a method for mounting the LEDs 30 on the substrate 4 is not limited to the chip-on-board manner. For example, the bare chips of the LEDs 30 may be housed in packages, and the packages may be mounted on the substrate 4 in a surface mounting technology.

As shown in FIG. 2, the cooling control circuit 2 includes a plurality of (two, in the present embodiment) temperature measurement circuits 210 (a first temperature measurement circuit 20 and a second temperature measurement circuit 21), a plurality of (two, in the present embodiment) output circuits 240 (a first output circuit 22 and a second output circuit 23), and an output control circuit 24.

The temperature measurement circuits 210 (20 and 21) are used for measuring surrounding temperatures thereof.

In the present embodiment, as shown in FIG. 2, the temperature measurement circuits 20 and 21 are disposed on the opposite sides of the light source 3. In more detail, when the light source 3 is imaginarily divided into a left region (first region) 31 (31A) and a right region (second region) 31B as shown in FIG. 2, the first temperature measurement circuit 20 is positioned to measure a temperature of the left region (first region) 31A of the light source 3, and the second temperature measurement circuit 21 is positioned to measure a temperature of the right region (second region) 31B of the light source 3. Note that, in the present embodiment, the light source 3 is treated as being divided into the two regions 31, but the light source 3 may be imaginarily divided into more than two regions 31 and the temperature measurement circuits 210 may be positioned to measure the more than two regions 31 respectively.

The first temperature measurement circuit 20 is a series circuit of a thermosensitive device RX (RX1) and a resistor R3, for example. The first temperature measurement circuit 20 divides a power supply voltage supplied from the first output circuit 22 by use of the thermosensitive device RX (RX1) and the resistor R3, and provides the divided voltage, as a detection voltage (first detection voltage), to the output control circuit 24.

The second temperature measurement circuit 21 is a series circuit of a thermosensitive device RX (RX2) and a resistor R4, for example. The second temperature measurement circuit 21 divides the power supply voltage supplied from the first output circuit 22 by use of the thermosensitive device RX (RX2) and the resistor R4, and provides the divided voltage, as a detection voltage (second detection voltage), to the output control circuit 24.

In the present embodiment, each of the thermosensitive devices RX (RX1 and RX2) is an NTC thermistor whose resistance decreases with an increase in temperature. Thus, the detection voltages vary with a change in the surrounding temperatures. Note that, each of the thermosensitive devices RX (RX1 and RX2) may be a PTC thermistor whose resistance increases with an increase in temperature, or a CTR thermistor whose resistance exponentially decreases as temperature exceeds a certain temperature.

The plurality of output circuits 240 (the first output circuit 22 and the second output circuit 23) supply drive voltages to plurality of (two, in the present embodiment) cooling devices 9 (the first cooling device 9A and the second cooling device 9B) by use of power from the power source 1 to drive the plurality of cooling devices 9 (9A and 9B), respectively.

The first output circuit 22 receives the output voltage from the DC power source 1, and supplies the drive voltage to a first fan motor 50A of a first fan 5A serving as the cooling device 9A for cooling the light source 3. An air volume of the first fan 5A varies with a variation in the drive voltage outputted from the first output circuit 22.

The first cooling device 9A includes the fan 5 (the first fan 5A) and the fan motor 50 (the first fan motor 50A) configured to drive the fan 5A. For example, the cooling device 9A is configured increase a cooling capacity thereof with an increase in the drive voltage supplied thereto. In brief, as the supplied drive voltage is increased, the cooling device 9A increase an amount of heat removed from the corresponding region 31A of the light source 3.

The second output circuit 23 receives the output voltage from the DC power source 1, and supplies the drive voltage to a second fan motor 50B of a second fan 5B serving as the cooling device 9B for cooling the light source 3. An air volume of the second fan 5B varies with a variation in the drive voltage outputted from the second output circuit 24.

The second cooling device 9B includes the fan 5 (the second fan 5B) and the fan motor 50 (the second fan motor 50B) configured to drive the fan 5B. For example, the cooling device 9B is configured to increase a cooling capacity thereof with an increase in the drive voltage supplied thereto. In brief, as the supplied drive voltage is increased, the cooling device 9B increase an amount of heat removed from the corresponding region 31B of the light source 3.

In the present embodiment, the first fan 5A is placed to cool the left region 31A of the light source 3, and the second fan 5B is placed to cool the right region 31B of the light source 3. Note that, when the light source 3 is imaginarily divided into more than two regions 31, the fans 5 (cooling devices 9) may be placed to cool the respective corresponding regions 31.

For example, as shown in FIG. 2, the first output circuit 22 includes a semiconductor device IC1, a diode D3, an inductor L3, capacitors C3 and C4, a photodiode PD1, a phototransistor PT1, and zener diodes ZD1 and ZD2.

Additionally, the first output circuit 22 further includes a switching device Q3 which is an n-type MOSFET and is connected in series with a series circuit of the photodiode PD1 and the zener diode ZD1.

Additionally, the first output circuit 22 includes a semiconductor device IC2 and a capacitor C5. The semiconductor device IC2 is a three-terminal regulator. The capacitor C5 is connected between a power terminal 24E and a ground terminal 24F of the output control circuit 24. Further, each of the temperature measurement circuits 210 (20 and 21) is connected to a connection point between the capacitor C5 and the semiconductor device IC2.

For example, the semiconductor device IC1 is constituted by use of LNK302 available from POWER INTEGRATIONS, and includes a switching device and a control circuit therefor which are not shown. Further, the photodiode PD1 and the phototransistor PT1 constitute a photo coupler.

In this regard, the first output circuit 22 has a function of outputting the drive voltage to the first fan motor 50A and additionally functions as a power supply circuit configured to receive the output voltage from the DC power source 1 and generate the power supply voltage to be supplied to each of the temperature measurement circuits 210 (20 and 21) and the output control circuit 24.

Hereinafter, operation of the first output circuit 22 when used as the power supply circuit is described.

While a switching device inside the semiconductor device IC1 is turned on, a current flows through the semiconductor device IC1 and the inductor L3, and therefore the capacitor C4 is charged. While the switching device Q3 is turned on, when a voltage across the capacitor C4 exceeds a zener voltage of the zener diode ZD1, a current flows through the zener diode ZD1 and the photodiode PD1, and then the phototransistor PT1 is turned on. Consequently, the switching device inside the semiconductor device IC1 is turned off, and thus power supply to the semiconductor device IC1 and the inductor L3 is interrupted.

Thereafter, when the voltage across the capacitor C4 falls below the zener voltage of the zener diode ZD1 after the capacitor C4 starts to discharge, no current flows through the photodiode PD1. Hence, the phototransistor PT1 is turned off, and the switching device inside the semiconductor device IC1 is turned on.

By repeating the action described above, the voltage across the capacitor C4 is kept a constant DC voltage. The voltage across the capacitor C4 is converted into a constant DC voltage different from the voltage across the capacitor C4 through the semiconductor IC2 and the capacitor C5. Consequently, the voltage (constant voltage) across the capacitor C5 is supplied to the temperature measurement circuits 20 and 21 and the output control circuit 24 as the power supply voltage.

As described above, the first output circuit 22 outputs the constant voltage by use of power supplied from the power source (DC power source) 1. Especially, in the present embodiment, the first output circuit 22 outputs the constant voltage by use of the output voltage generated by the step-up chopper circuit (first circuit) 110.

The second output circuit 23 includes a semiconductor device IC3, a diode D4, an inductor L4, capacitors C6 and C7, a photodiode PD2, a phototransistor PT2, and zener diodes ZD3 and ZD4.

Additionally, the second output circuit 23 further includes a switching device Q4 which is an n-type MOSFET and is connected in series with a series circuit of the photodiode PD2 and the zener diode ZD3.

For example, the semiconductor device IC3 is constituted by use of LNK302 available from POWER INTEGRATIONS, and includes a switching device and a control circuit therefor which are not shown. Further, the photodiode PD2 and the phototransistor PT2 constitute a photo coupler.

As shown in FIG. 2, the second output circuit 23 has the same configuration as the first output circuit 22 with the exception of the semiconductor device IC2 and the capacitor C5. Therefore, in the second output circuit 23, the voltage across the capacitor C7 is kept a constant DC voltage while the switching device Q4 is turned on.

Note that, the output circuits 22 and 23 are respectively constituted by the semiconductor devices IC1 and IC3 each including the switching device and the control circuit therefor, which are integrated, but another configuration may be used. For example, the first output circuit 22 may be configured to generate the power supply voltage by use of a voltage induced in an auxiliary winding provided to the inductor L1 of the step-up chopper circuit 110. Alternatively, in the output circuits 22 and 23, the semiconductor devices IC1 and IC3 each may be replaced with the switching device and the control circuit for the switching device which are provided separately.

The output control circuit 24 regulates the drive voltages respectively outputted from the plurality of output circuits 240 based on the temperatures respectively measured by the plurality of temperature measurement circuits 210. In the present embodiment, the output control circuit 24 controls the drive voltage of the first output circuit 22 based on the temperature measured by the first temperature measurement circuit 20. Accordingly, the first cooling device 9A cools the first region 31A of the light source 3 based on the temperature of the first region 31A. Further, the output control circuit 24 controls the drive voltage of the second output circuit 23 based on the temperature measured by the second temperature measurement circuit 21. Accordingly, the second cooling device 9B cools the second region 31B of the light source 3 based on the temperature of the second region 31B. As described above, each of the plurality of output circuits 240 is associated with the cooling device 9 and the temperature measurement circuit 210 to cool the region 31 of the light source 3 based on the temperature of this region 31.

The output control circuit 24 is constituted by an 8-bit microcomputer, for example. The output control circuit 24 controls the output circuit 240 (22, 23) to output the drive voltage depending on the temperature measured by the temperature measurement circuit 210 (20, 21).

For example, the output control circuit 24 includes a plurality of (two, in the present embodiment) A/D ports 24A and 24B, a CPU 24C, and a memory 24D. Further, the output control circuit 24 includes the power terminal 24E and the ground terminal 24F, which are described above.

The A/D port 24A has an input terminal connected between the thermosensitive device RX1 and the resistor R3 of the first temperature measurement circuit 20 and has an output terminal connected to the CPU 24C. The A/D port 24B has an input terminal connected between the thermosensitive device RX2 and the resistor R4 of the second temperature measurement circuit 21 and has an output terminal connected to the CPU 24C. The A/D ports 24A and 24B convert detection voltages inputted from the temperature measurement circuits 20 and 21 into digital values and output the resultant digital values to the CPU 24C, respectively.

The CPU 24C calculates an average, in a predetermined period, of the digital value (the digital value indicative of the first detection voltage) inputted from the A/D port 24A, and uses the calculated average as the digital value of the first detection voltage. Similarly, the CPU 24C calculates an average, in a predetermined period, of the digital value (the digital value indicative of the second detection voltage) inputted from the A/D port 24B, and uses the calculated average as the digital value of the second detection voltage.

In summary, the output control circuit 24 is configured to calculate an average temperature in a predetermined period for each of the plurality of temperature measurement circuits 210, and regulate the drive voltages of the plurality of output circuits 240 based on the averages of the plurality of temperature measurement circuits 210.

Figure 3:
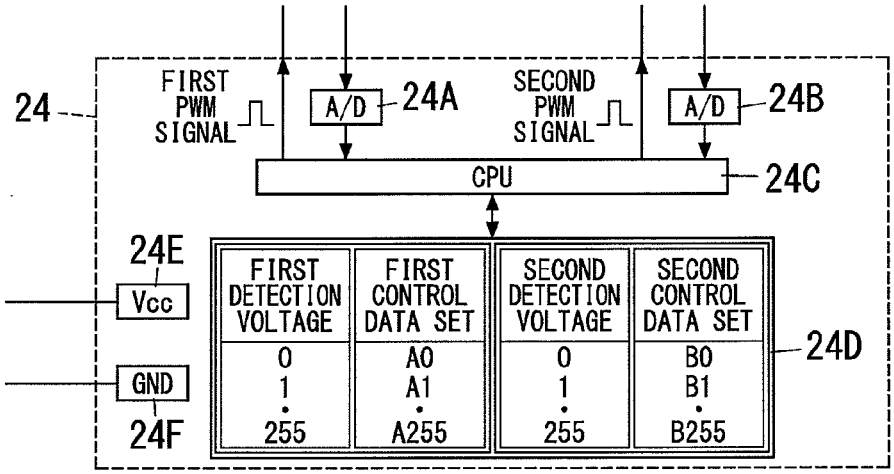
FIG. 3 is a schematic diagram illustrating an output control circuit of the lighting device of the first embodiment.

As shown in FIG. 3, in the memory 24D, a data table storing digital values indicative of the respective detection voltages and control data sets respectively associated with the digital values is memorized. The control data set is data used for controlling the output circuit 240. For example, the control data set is data for determining the magnitude of the drive voltage of the output circuit 240. For example, the control data set is data indicative of a duty cycle of a PWM signal to be outputted to the output circuit 220.

For example, the memory 24D memorizes a data table (see TABLE 1) dedicated to the first output circuit 22 and a data table (see TABLE 2) dedicated to the second output circuit 23. The data table dedicated to the first output circuit 22 shows a correspondence relation between the first detection voltages (the digital values of the first detection voltage) and first control data sets for the first output circuit 22. The data table dedicated to the second output circuit 23 shows a correspondence relation between the second detection voltages (the digital values of the second detection voltage) and second control data sets for the second output circuit 23. Note that, the digital value indicative of the detection voltage represents a value corresponding to the detection voltage, but does not necessarily represent a real detection voltage itself. For example, when the first detection voltage in the data table indicates a digital value of "5", it does not always mean "5 V".

TABLE 1

| FIRST DETECTION VOLTAGE | FIRST CONTROL DATA SET |
|---|---|
| 0 | A0 |
| 1 | A1 |
| . . . | . . . |
| 255 | A255 |

TABLE 2

| SECOND DETECTION VOLTAGE | SECOND CONTROL DATA SET |
|---|---|
| 0 | B0 |
| 1 | B1 |
| . . . | . . . |
| 255 | B255 |

The CPU 24C reads out the first control data set ("A0", "A1", . . . , "A255") and the second control data set ("B0", "B1", . . . , "B255") respectively corresponding to the digital values of the detection voltages from the memory 24D.

The CPU 24C outputs the PWM signals (the first PWM signal and the second PWM signal) based on the control data sets to the switching devices Q3 and Q4 of the output circuits 22 and 23, respectively. In brief, the output control circuit 24 outputs the first PWM signal based on the temperature measured by the first temperature measurement circuit 20 to the first output circuit 22. The output control circuit 24 outputs the second PWM signal based on the temperature measured by the second temperature measurement circuit 21 to the second output circuit 23.

As described above, the output control circuit 24 controls the output circuits 22 and 23 based on the averages in the predetermined period of the temperatures measured by the temperature measurement circuits 20 and 21, respectively. Hence, it is possible to reduce bad effect caused by noise included in the measured temperature (detection voltage). Consequently, false operation can be prevented. Note that, to more reduce the bad effect caused by the noise, it is preferable to use, as the digital value indicative of the detection voltage, an average of the digital values selected from all the digital values obtained during a predetermined period in such a way to exclude maximum and minimum values.

Next, operations of the respective output circuits 240 (the first output circuit 22 and the second output circuit 23) when outputting the drive voltages are described.

Figure 4:
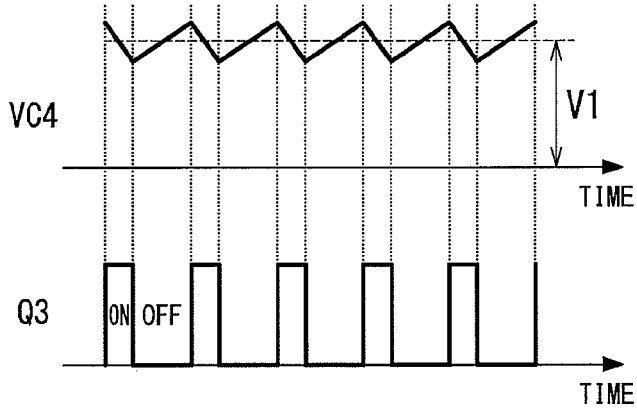
FIG. 4 is a waveform chart illustrating operation of a first output circuit of the lighting device of the first embodiment.

The first explanation referring to FIG. 4 is made to the operation of the first output circuit 22. The first PWM signal is inputted into a base terminal of the switching device Q3 of the first output circuit 22. Therefore, the switching device Q3 is turned on and off according to the duty cycle of the first PWM signal.

When the switching device Q3 is switched from an on-state to an off-state, no current flows through the photodiode PD1 and the zener diode ZD1, and therefore the phototransistor PT1 is turned off and the switching device inside the semiconductor device IC1 is turned on. Hence, a current starts to flow through the semiconductor device IC1 and the inductor L3 and accordingly the capacitor C4 is charged. Therefore, the voltage across the capacitor C4 increases while an upper limit thereof is equal to a zener voltage of the zener diode ZD2.

Next, when the switching device Q3 is turned on, a current starts to flow through the photodiode PD1 and the zener diode ZD1 and therefore the phototransistor PT1 is turned on. Accordingly, the switching device inside the semiconductor device IC1 is turned off and the current flowing through the semiconductor device IC1 and the inductor L3 is interrupted. Hence, the capacitor C4 starts to discharge and the voltage across the capacitor C4 decreases.

By repeating the action described above, the voltage VC4 across the capacitor C4 (i.e., the drive voltage for the first fan motor 50A) is kept to be a DC voltage V1 which is constant.

The duty cycle of the first PWM signal varies with the value of the first control data set. The duty cycle of the first PWM signal is maximized when the first control data set is "A0", and the duty cycle of the first PWM signal is minimized when the first control data set is "A255".

Therefore, when the temperature measured by the first temperature measurement circuit 20 increases, the duty cycle of the first PWM signal decreases and therefore the first output circuit 22 increases the drive voltage and outputs the increased drive voltage. Accordingly, the air volume of the first fan 5A is increased. Meanwhile, when the temperature measured by the first temperature measurement circuit 20 decreases, the duty cycle of the first PWM signal increases and therefore the first output circuit 22 decreases the drive voltage and outputs the decreased drive voltage. Accordingly, the air volume of the first fan 5A is decreased.

As described above, the output control circuit 24 increases the drive voltage of the first output circuit 22 with an increase in the temperature measured by the first temperature measurement circuit 20. Further, the output control circuit 24 decreases the drive voltage of the first output circuit 22 with a decrease in the temperature measured by the first temperature measurement circuit 20.

Figure 5:
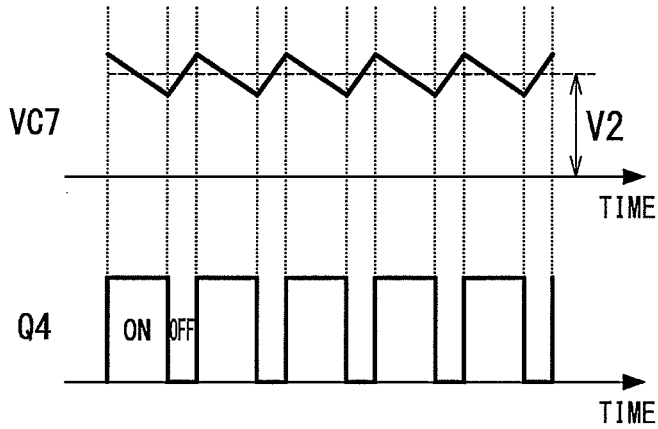
FIG. 5 is a waveform chart illustrating operation of a second output circuit of the lighting device of the first embodiment.

The second explanation referring to FIG. 5 is made to the operation of the second output circuit 23.

The second PWM signal is inputted into a base terminal of the switching device Q4 of the second output circuit 23. Therefore, the switching device Q4 is turned on and off according to the duty cycle of the second PWM signal.

When the switching device Q4 is switched from an on-state to an off-state, no current flows through the photodiode PD2 and the zener diode ZD3, and therefore the phototransistor PT2 is turned off and the switching device inside the semiconductor device IC3 is turned on. Hence, a current starts to flow through the semiconductor device IC3 and the inductor L4 and accordingly the capacitor C7 is charged. Therefore, the voltage across the capacitor C7 increases while an upper limit thereof is equal to a zener voltage of the zener diode ZD4.

Next, when the switching device Q4 is turned on, a current starts to flow through the photodiode PD2 and the zener diode ZD3 and therefore the phototransistor PT2 is turned on. Accordingly, the switching device inside the semiconductor device IC3 is turned off and the current flowing through the semiconductor device IC3 and the inductor L4 is interrupted. Hence, the capacitor C7 starts to discharge and the voltage across the capacitor C7 decreases.

By repeating the action described above, the voltage VC7 across the capacitor C7 (i.e., the drive voltage for the second fan motor 50B) is kept to be a DC voltage V2 which is constant.

The duty cycle of the second PWM signal varies with the value of the second control data set. The duty cycle of the second PWM signal is maximized when the second control data set is "B0", and the duty cycle of the second PWM signal is minimized when the second control data set is "B255".

Therefore, when the temperature measured by the second temperature measurement circuit 21 increases, the duty cycle of the second PWM signal decreases and therefore the second output circuit 23 increases the drive voltage and outputs the increased drive voltage. Accordingly, the air volume of the second fan 5B is increased. Meanwhile, when the temperature measured by the second temperature measurement circuit 21 decreases, the duty cycle of the second PWM signal increases and therefore the second output circuit 23 decreases the drive voltage and outputs the decreased drive voltage. Accordingly, the air volume of the second fan 5B is decreased.

As described above, the output control circuit 24 increases the drive voltage of the second output circuit 23 with an increase in the temperature measured by the second temperature measurement circuit 21. Further, the output control circuit 24 decreases the drive voltage of the second output circuit 23 with a decrease in the temperature measured by the second temperature measurement circuit 21.

In summary, the output control circuit 24 is configured to increase the drive voltage with regard to each of the plurality of the output circuits 240 (22 and 23) with an increase in the temperature measured by a corresponding one of the plurality of temperature measurement circuits 210 (20 and 21).

Note that, it is not necessarily that the switching devices Q3 and Q4 are turned on and off simultaneously.

As described above, in the present embodiment, the temperatures of the respective regions 31 of the light source 3 are measured by the temperature measurement circuits 210 (20 and 21), and the output control circuit 24 regulates the outputs of the fans 5A and 5B (the cooling devices 9A and 9B) based on the temperatures of the respective regions 31 of the light source 3.

Hence, the present embodiment can cool the light source 3 such that the temperatures of the regions 31 are equal to optimal temperatures respectively. Accordingly, it is possible to reduce a temperature difference in the light source 3. Therefore, the present embodiment can reduce the temperature difference in the light source 3 and thus can stabilize the light output of the light source 3, and can prevent the light output from being unstable.

Further, the present embodiment can prevent an undesired event in which the LED has such a local temperature that exceeds an allowable operating temperature and this causes a great deterioration in luminous flux and a great decrease in lifetime and in some cases the light source is turned off.

Furthermore, the present embodiment is different from the prior art in that the present embodiment does not require LEDs for providing power to cooling devices. Hence, there is no need to use LEDs able to withstand an increase in a forward current and therefore the production cost can be reduced.

Note that, it is preferable that the output control circuit 24 control the output circuits 240 (22 and 23) to decrease a difference between the temperatures measured by the temperature measurement circuits 210 (20 and 21). For example, the output control circuit 24 may be configured to compare the temperatures measured by the temperature measurement circuits 20 and 21, and control the output circuit 22 (or 23) corresponding to the temperature measurement circuit that has measured a higher one of the measured temperatures.

In more detail, the output control circuit 24 is configured to control the plurality of output circuits 240 so as to reduce a difference between two temperatures (the temperature measured by the first temperature measurement circuit 20 and the temperature measured by the second temperature measurement circuit 21) selected from the temperatures respectively measured by the plurality of temperature measurement circuits 210. In other words, the plurality of temperature measurement circuits 210 include the first temperature measurement circuit 20 and the second temperature measurement circuit 21, and the output control circuit 24 controls the plurality of output circuits 240 to reduce a difference between the temperatures respectively measured by the first and second temperature measurement circuits 20 and 21. In this regard, it is preferred that the two temperatures selected from the plurality of temperatures respectively measured by the plurality of temperature measurement circuits 210 are the maximum temperature and the minimum temperature.

Further, the output control circuit 24 is configured to control the output circuit 240 corresponding to the temperature measurement circuit that has measured a higher one of the two temperatures. In other words, the output control circuit 24 controls the output circuit 240 corresponding to the temperature measurement circuit that has measured a higher one of the temperature measured by the first temperature measurement circuit 20 and the temperature measured by the second temperature measurement circuit 21. In brief, the output control circuit 24 controls the output circuit 240 corresponding to the temperature measurement circuit that has measured the maximum one of the plurality of temperatures respectively measured by the plurality of temperature measurement circuits 210.

In this regard, each of the plurality of cooling devices 9 is configured to increase a cooling capacity thereof with an increase in the drive voltage supplied thereto. The output control circuit 24 is configured to increase the drive voltage of the output circuit 240 corresponding to the temperature measurement circuit that has measured the higher one of the two temperatures.

For example, when the temperature measured by the first temperature measurement circuit 20 is higher than the temperature measured by the second temperature measurement circuit 21, the output control circuit 24 controls the first output circuit 22 associated with the first temperature measurement circuit 20 to increase the drive voltage of the first output circuit 22. When the temperature measured by the second temperature measurement circuit 21 is higher than the temperature measured by the first temperature measurement circuit 20, the output control circuit 24 controls the second output circuit 23 associated with the second temperature measurement circuit 21 to increase the drive voltage of the second output circuit 23. Accordingly, it is possible to reduce a difference between the temperature measured by the first temperature measurement circuit 20 (i.e., the temperature of the region 31A) and the temperature measured by the second temperature measurement circuit 21 (i.e., the temperature of the region 31B).

Figure 6:
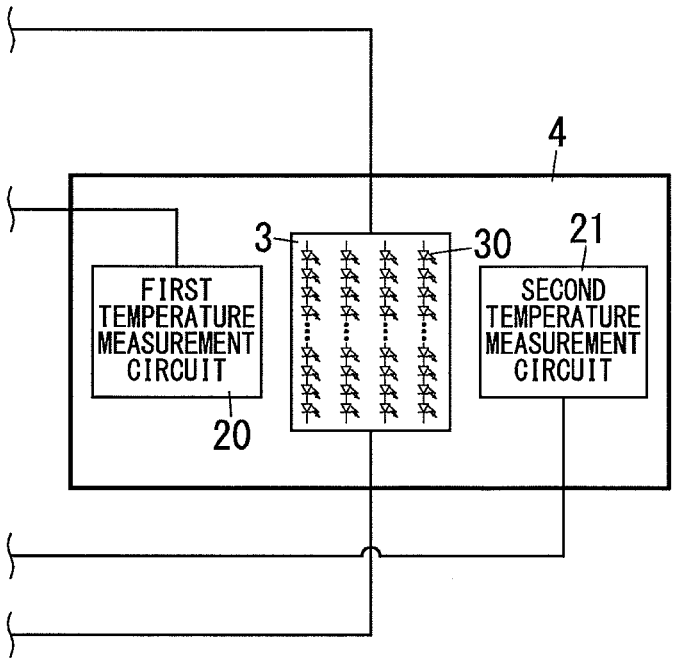
FIG. 6 is a diagram illustrating another example where temperature measurement circuits are mounted on a substrate with regard to the first embodiment.

For example, as shown in FIG. 6, the respective temperature measurement circuits 210 (20 and 21) may be mounted on the substrate 4 on which the light source 3 is to be mounted. This configuration enables efficient use of a space on the substrate 4, and therefore it is possible to downsize the device. Additionally, the temperature measurement circuits 20 and 21 can be positioned closer to the light source 3 and accordingly it is possible to measure the temperature of the light source 3 more precisely.

Accordingly, this configuration can more facilitate optimization of the temperature of the light source 3 in comparison with the configurations shown in FIGS. 1 and 2, and therefore it is possible to suppress a deterioration in the light output and the lifetime of the LED 30 due to a high temperature. Note that, instead of mounting all the components of the temperature measurement circuits 210 (20 and 21) on the substrate 4, only the thermosensitive devices RX1 and RX2 may be mounted on the substrate 4.

As described above, the lighting device of the present embodiment includes the following first feature.

According to the first feature, the lighting device includes: the power source 1 configured to supply power to the light source 3 configured to emit light when energized; the plurality of cooling devices 9 configured to cool the light source 3; and the cooling control circuit 2 configured to control each of the plurality of cooling devices 9. The cooling control circuit 2 includes: the plurality of output circuits 240 configured to output the drive voltage for operating the plurality of cooling devices 9 respectively; the plurality of temperature measurement circuits 210 configured to measure the temperatures of the surroundings thereof respectively; and the output control circuit 24 configured to control the plurality of output circuits 240 to output the drive voltages depending on the temperatures measured by the plurality of temperature measurement circuits 210 respectively. When the light source 3 is divided into the plurality of regions 31 imaginarily, the plurality of temperature measurement circuits 210 are placed to measure the temperatures of the plurality of regions 31 respectively, and the plurality of cooling devices 9 are positioned to cool the plurality of regions 31 of the light source 3 respectively.

In other words, the lighting device includes: the power source 1 configured to supply power to the light source 3 having the plurality of regions 31; the plurality of cooling devices 9 arranged corresponding to the plurality of regions 31 to cool the plurality of regions 31, respectively; and the cooling control circuit 2 configured to control the plurality of cooling devices 9. The cooling control circuit 2 includes: the plurality of output circuits 240; the plurality of temperature measurement circuits 210; and the output control circuit 24. The plurality of output circuits 240 are configured to supply the drive voltages to the plurality of cooling devices 9 by use of power from the power source 1 to drive the plurality of cooling devices 9, respectively. The plurality of temperature measurement circuits 210 are configured to respectively measure temperatures of the plurality of regions 31. The output control circuit 24 is configured to regulate the drive voltages, which are respectively supplied from the plurality of output circuits 240, based on the temperatures respectively measured by the plurality of temperature measurement circuits 210.

Further, the lighting device of the present embodiment includes the following second to fourth features. Besides, the second to fourth features are optional.

According to the second feature relying on the first feature, the output control circuit 24 controls the output circuits 240 to reduce a difference between the temperatures measured by the temperature measurement circuits 210. In other words, the output control circuit 24 is configured to control the plurality of output circuits 240 so as to reduce a difference between two temperatures selected from the temperatures respectively measured by the plurality of temperature measurement circuits 210.

According to the third feature relying on the second feature, the output control circuit 24 controls the output circuit 240 corresponding to the temperature measurement circuit 210 that has measured a higher one of the plurality of temperatures measured by the temperature measurement circuits 210 respectively. In other words, the output control circuit 24 is configured to control the output circuit 240 corresponding to the temperature measurement circuit 210 that has measured a higher one of the two temperatures (i.e., the two temperatures selected from the plurality of temperatures respectively measured by the plurality of temperature measurement circuits 210).

According to the fourth feature relying on the third feature, each of the plurality of cooling devices 9 is configured to increase a cooling capacity thereof with an increase in the drive voltage supplied thereto. The output control circuit 24 is configured to increase the drive voltage of the output circuit 240 corresponding to the temperature measurement circuit 210 that has measured the higher one of the two temperatures (i.e., the two temperatures selected from the plurality of temperatures respectively measured by the plurality of temperature measurement circuits 210).

Furthermore, the lighting device of the present embodiment includes the following fifth to seventh features. Besides, the fifth to seventh features are optional.

According to the fifth feature relying on any one of the first to fourth features, each of the plurality of temperature measurement circuits 210 includes the thermosensitive device RX having a characteristic value varying with a temperature.

According to the sixth feature relying on the fifth feature, the thermosensitive device RX is an NTC thermistor, a PTC thermistor, or a CTR thermistor.

According to the seventh feature relying on any one of the first to sixth features, the light source 3 is configured to light up when energized.

As described above, in the lighting device of the present embodiment, the temperatures of the respective regions 31 of the light source 3 are measured by the temperature measurement circuits 210, and the output control circuit 24 regulates the outputs of the cooling devices 9 based on the temperatures of the respective regions 31 of the light source 3. Hence, the lighting device of the present embodiment can cool the light source 3 such that the temperatures of the regions 31 are equal to optimal temperatures respectively. Accordingly, it is possible to reduce a difference in temperature in the light source 3. Furthermore, the lighting device of the present embodiment is different from the prior art in that the present embodiment does not require LEDs for providing power to cooling devices. Hence, there is no need to use LEDs able to withstand an increase in a forward current and therefore the production cost can be reduced.

The following explanation referring to the drawings is made to the lighting device of the second embodiment according to the present invention. Note that, the lighting device of the present embodiment has the same basic configuration as the first embodiment and therefore components common to the present and first embodiments are designated by the same reference numerals, and explanations thereof are deemed unnecessary.

Figure 7:
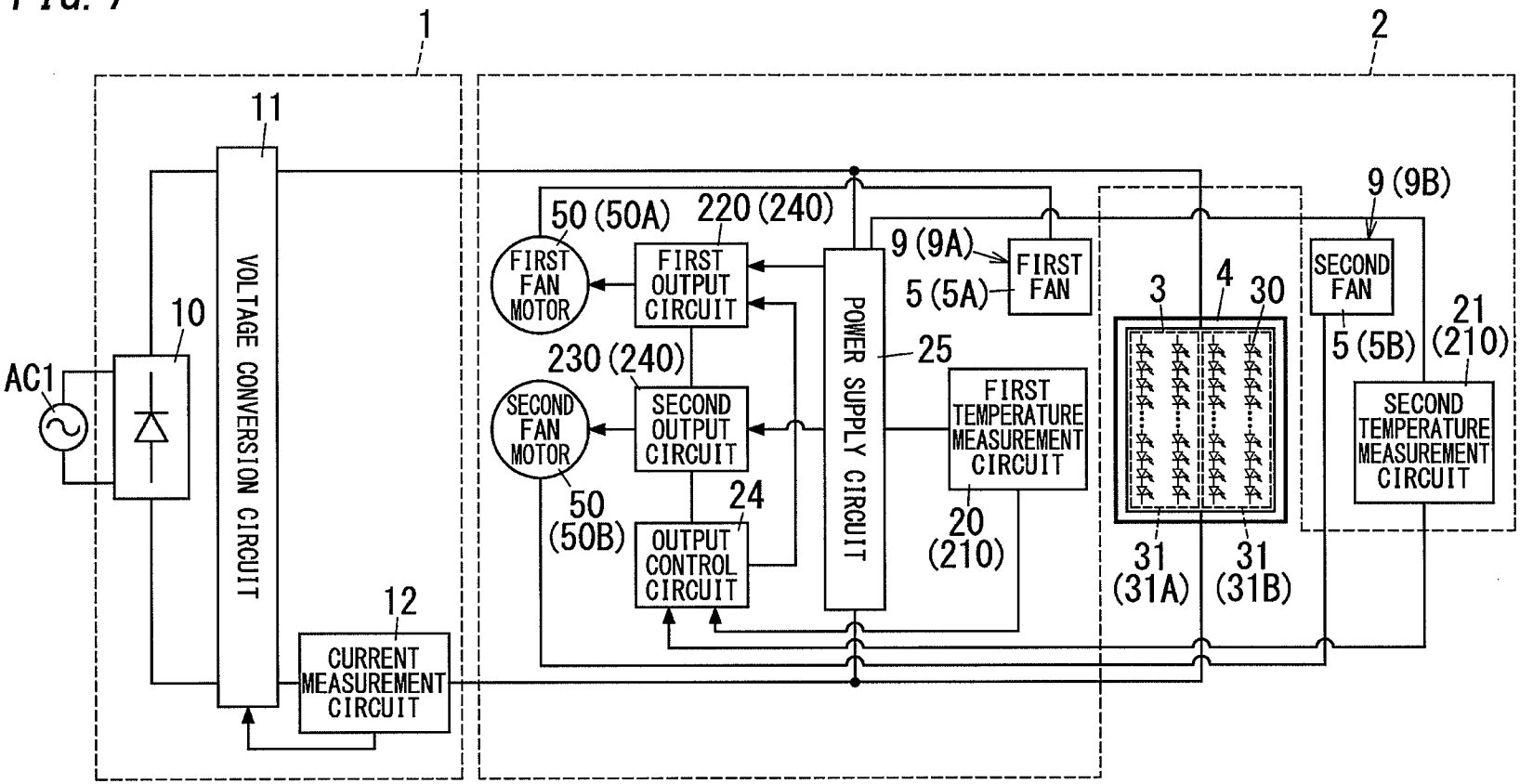
FIG. 7 is a schematic circuit diagram illustrating a lighting device of the second embodiment.

As shown in FIG. 7, the lighting device of the present embodiment, instead of the output circuits 22 and 23 of the first embodiment, includes a first output circuit 220 (240), a second output circuit 230 (240), and a power supply circuit 25. Note that, the output control circuit 24 of the present embodiment has the same configuration as that of the first embodiment (see FIG. 3).

The power supply circuit 25 receives the output voltage from the DC power source 1 and generates the power supply voltage that is to be supplied to each of the temperature measurement circuits 20 and 21, the output circuits 240 (220 and 230), and the output control circuit 24.

Figure 8:
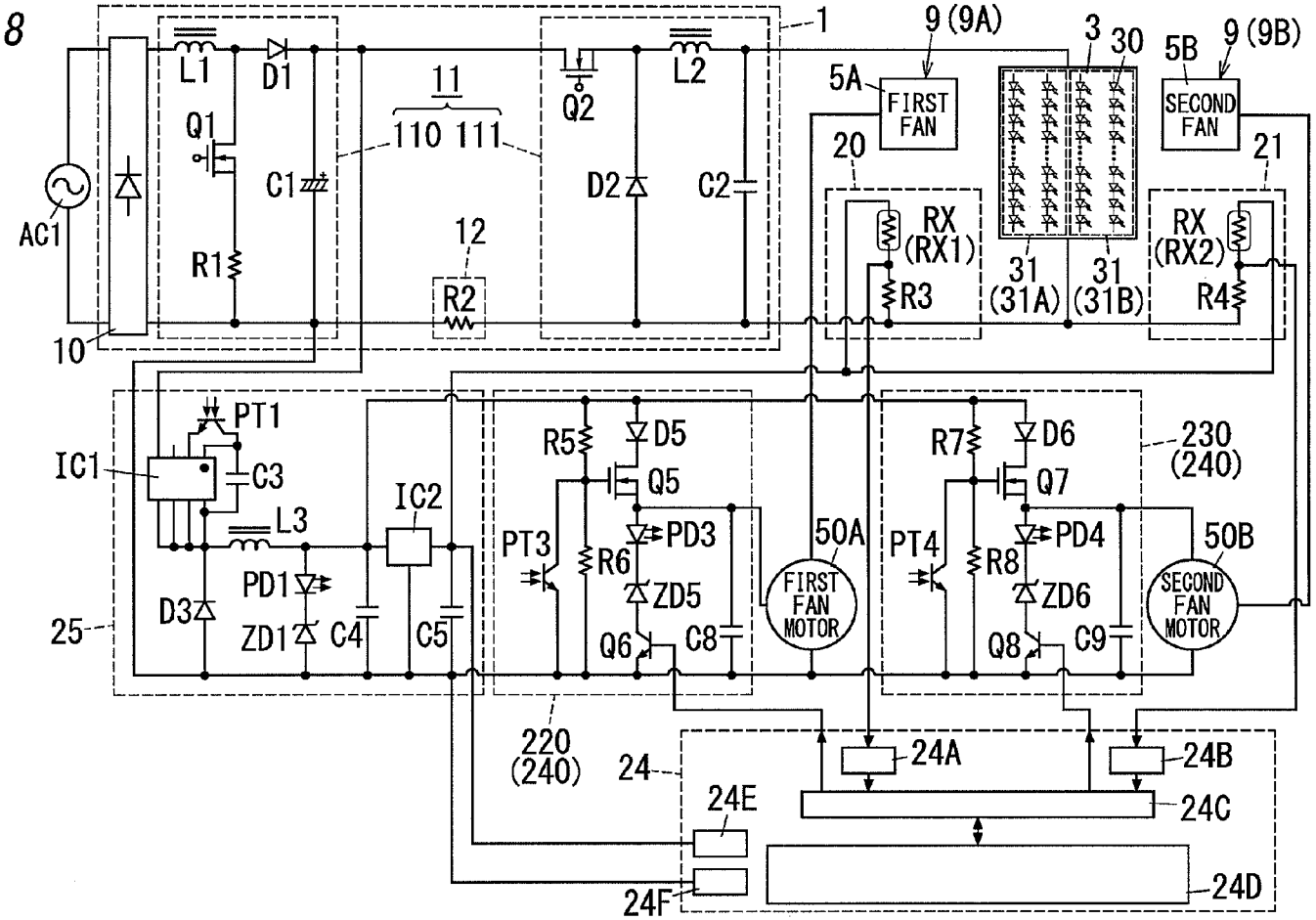
FIG. 8 is a concrete circuit diagram illustrating the lighting device of the second embodiment.

For example, as shown in FIG. 8, the power supply circuit 25 has such a structure that the switching device Q3 and the zener diode ZD2 are eliminated from the first output circuit 22 of the first embodiment. In summary, the power supply circuit 25 includes the semiconductor device IC1, the diode D3, the inductor L3, the capacitors C3 and C4, the photodiode PD1, the phototransistor PT1, the zener diode ZD1, the semiconductor device IC2, and the capacitor C5.

Hereinafter, operation of the power supply circuit 25 is described.

While a switching device inside the semiconductor device IC1 is turned on, a current flows through the semiconductor device IC1 and the inductor L3, and therefore the capacitor C4 is charged. When a voltage across the capacitor C4 exceeds a zener voltage of the zener diode ZD1, a current flows through the zener diode ZD1 and the photodiode PD1, and then the phototransistor PT1 is turned on. Consequently, the switching device inside the semiconductor device IC1 is turned off, and thus power supply to the semiconductor device IC1 and the inductor L3 is interrupted.

Thereafter, when the voltage across the capacitor C4 falls below the zener voltage of the zener diode ZD1 after the capacitor C4 starts to discharge, no current flows through the photodiode PD1. Hence, the phototransistor PT1 is turned off, and the switching device inside the semiconductor device IC1 is turned on.

By repeating the action described above, the voltage across the capacitor C4 is kept a constant DC voltage. The voltage across the capacitor C4 is supplied to the output circuits 220 and 230 as a power supply voltage. Further, the voltage across the capacitor C4 is converted into a constant DC voltage different from the voltage across the capacitor C4, by use of the semiconductor IC2 and the capacitor C5. Consequently, the voltage (constant voltage) across the capacitor C5 is supplied to the temperature measurement circuits 20 and 21 and the output control circuit 24 as the power supply voltage.

As described above, the power supply circuit 25 outputs the constant voltage by use of power supplied from the power source (DC power source) 1. Especially, in the present embodiment, the power supply circuit 25 outputs the constant voltage by use of the output voltage generated by the step-up chopper circuit (first circuit) 110.

The plurality of output circuits 240 (the first output circuit 220 and the second output circuit 230) each are configured to receive the constant voltage (power supply voltage) from the power supply circuit 25 as the power from the power source 1 and generate the drive voltage by use of the constant voltage.

The first output circuit 220 receives the output voltage from the power supply circuit 25, and supplies a drive voltage to the first fan motor 50A (the first cooling device 9A) to drive the first fan motor 50A. For example, as shown in FIG. 6, the first output circuit 220 includes resistors R5 and R6, a diode D5, switching devices Q5 and Q6, a photodiode PD3, a phototransistor PT3, a zener diode ZD5, and a capacitor C8. The switching device Q5 is an n-type MOSFET. The switching device Q6 is an npn-type transistor. Further, the photodiode PD3 and the phototransistor PT3 constitute a photo coupler.

The second output circuit 230 receives the output voltage from the power supply circuit 25, and supplies a drive voltage to the second fan motor 50B (the second cooling device 9B) to drive the second fan motor 50B. For example, as shown in FIG. 6, the second output circuit 230 includes resistors R7 and R8, a diode D6, switching devices Q7 and Q8, a photodiode PD4, a phototransistor PT4, a zener diode ZD6, and a capacitor C9. The switching device Q7 is an n-type MOSFET. The switching device Q8 is an npn-type transistor. Further, the photodiode PD4 and the phototransistor PT4 constitute a photo coupler.

In the present embodiment, the plurality of output circuits 240 (the first output circuit 220 and the second output circuit 230) have the same circuit configuration. However, the plurality of output circuits 240 (the first output circuit 220 and the second output circuit 230) may have different circuit configurations.

Next, operations of the respective output circuits 220 and 230 are described.

Figure 9:
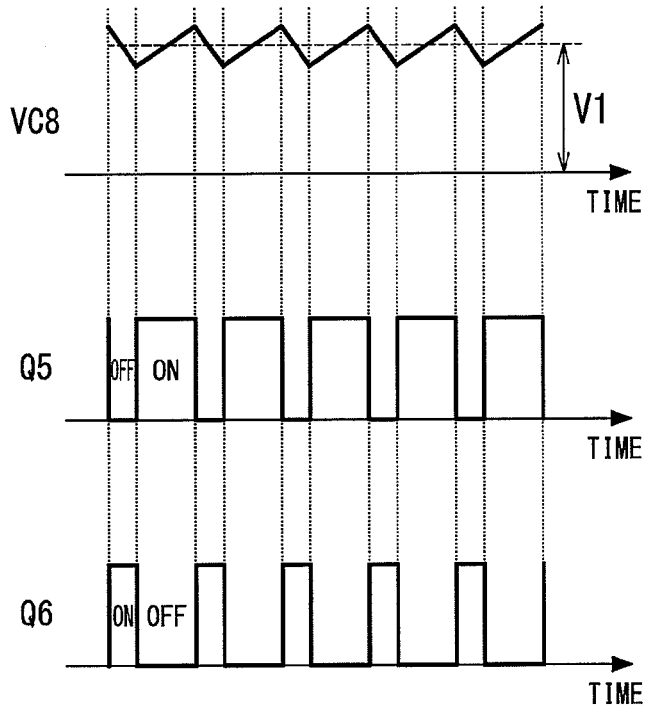
FIG. 9 is a waveform chart illustrating operation of a first output circuit of the lighting device of the second embodiment.

The first explanation referring to FIG. 9 is made to the operation of the first output circuit 220.

In the first output circuit 220, the power supply voltage supplied from the power supply circuit 25 is divided through the resistors R5 and R6 and the divided voltage is inputted into a gate terminal of the switching device Q5. Hence, normally, the switching device Q5 is kept turned on. In this regard, the first PWM signal is inputted into a base terminal of the switching device Q6. Consequently, the switching device Q6 is turned on and off based on the duty cycle of the first PWM signal.

While the switching device Q6 is turned off, a current flows through the diode D5 and the switching device Q5 and therefore the capacitor C8 is charged.

When a voltage VC8 across the capacitor C8 exceeds a zener voltage of the zener diode ZD5 after the switching device Q6 is turned on, a current flows through the photodiode PD3 and thus the phototransistor PT3 is turned on.

Thereafter, the switching device Q5 is turned off, and current supply to the capacitor C8 is interrupted and the capacitor C8 starts to discharge.

When the switching device Q6 is turned off again, a flow of a current through the photodiode PD3 is interrupted, and therefore the phototransistor PT3 is turned off. Hence, the switching device Q5 is turned on and a current starts to flow through the diode D5 and the switching device Q5 and the capacitor C8 is charged again.

By repeating the action described above, the voltage VC8 across the capacitor C8 (i.e., the drive voltage for the first fan motor 50A) is kept a DC voltage V1 which is constant.

In a similar manner as the first embodiment, this DC voltage V1 decreases with an increase in the duty cycle of the first PWM signal and increases with a decrease in the duty cycle of the first PWM signal.

Therefore, when the temperature measured by the first temperature measurement circuit 20 increases, the duty cycle of the first PWM signal decreases and accordingly the first output circuit 220 increases the drive voltage and outputs the increased drive voltage. Consequently, the air volume of the first fan 5A is increased.

Meanwhile, when the temperature measured by the first temperature measurement circuit 20 decreases, the duty cycle of the first PWM signal increases and therefore the first output circuit 220 decreases the drive voltage and outputs the decreased drive voltage. Accordingly, the air volume of the first fan 5A is decreased.

As described above, the output control circuit 24 increases the drive voltage of the first output circuit 220 with an increase in the temperature measured by the first temperature measurement circuit 20. Further, the output control circuit 24 decreases the drive voltage of the first output circuit 220 with a decrease in the temperature measured by the first temperature measurement circuit 20.

Figure 10:
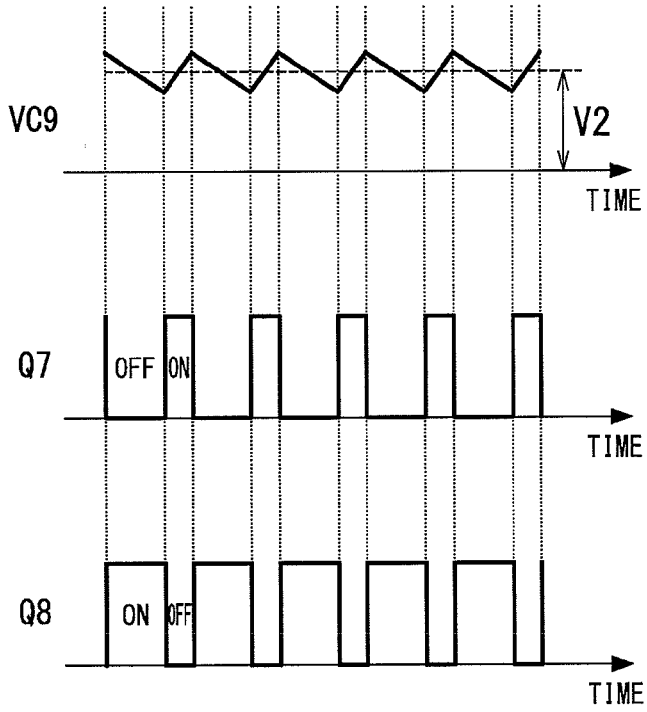
FIG. 10 is a waveform chart illustrating operation of a second output circuit of the lighting device of the second embodiment.

The second explanation referring to FIG. 10 is made to the operation of the second output circuit 230.

In the second output circuit 230, the power supply voltage supplied from the power supply circuit 25 is divided through the resistors R7 and R8 and the divided voltage is inputted into a gate terminal of the switching device Q7. Hence, normally, the switching device Q7 is kept turned on. In this regard, the second PWM signal is inputted into a base terminal of the switching device Q8. Consequently, the switching device Q8 is turned on and off based on the duty cycle of the second PWM signal.

While the switching device Q8 is turned off, a current flows through the diode D6 and the switching device Q7 and therefore the capacitor C9 is charged.

When a voltage VC9 across the capacitor C9 exceeds a zener voltage of the zener diode ZD6 after the switching device Q8 is turned on, a current flows through the photodiode PD4 and thus the phototransistor PT4 is turned on. Thereafter, the switching device Q7 is turned off, and current supply to the capacitor C9 is interrupted and the capacitor C9 starts to discharge.

When the switching device Q8 is turned off again, a flow of a current through the photodiode PD4 is interrupted, and therefore the phototransistor PT4 is turned off. Hence, the switching device Q7 is turned on and a current starts to flow through the diode D6 and the switching device Q7 and the capacitor C9 is charged again.

By repeating the action described above, the voltage VC9 across the capacitor C9 (i.e., the drive voltage for the second fan motor 50B) is kept a DC voltage V2 which is constant.

In a similar manner as the first embodiment, this DC voltage V2 decreases with an increase in the duty cycle of the second PWM signal and increases with a decrease in the duty cycle of the second PWM signal.

Therefore, when the temperature measured by the second temperature measurement circuit 21 increases, the duty cycle of the second PWM signal decreases and accordingly the second output circuit 230 increases the drive voltage and outputs the increased drive voltage. Consequently, the air volume of the second fan 5B is increased.

Meanwhile, when the temperature measured by the second temperature measurement circuit 21 decreases, the duty cycle of the second PWM signal increases and therefore the second output circuit 230 decreases the drive voltage and outputs the decreased drive voltage. Accordingly, the air volume of the second fan 5B is decreased.

As described above, the output control circuit 24 increases the drive voltage of the second output circuit 230 with an increase in the temperature measured by the second temperature measurement circuit 21. Further, the output control circuit 24 decreases the drive voltage of the second output circuit 230 with a decrease in the temperature measured by the second temperature measurement circuit 21.

In summary, the output control circuit 24 is configured to increase the drive voltage with regard to each of the plurality of the output circuits 240 (220 and 230) with an increase in the temperature measured by a corresponding one of the plurality of temperature measurement circuits 210 (20 and 21).

Note that, it is not necessarily that the switching devices Q6 and Q8 are turned on and off simultaneously.

As described above, like the first embodiment, in the lighting device of the present embodiment, the temperatures of the respective regions 31 of the light source 3 are measured by the temperature measurement circuits 20 and 21, and the output control circuit 24 regulates the outputs of the fans 5A and 5B (the cooling devices 9A and 9B) based on the temperatures of the respective regions 31 of the light source 3. Hence, the present embodiment can provide the same advantageous effect as that of the first embodiment.

Further, in the present embodiment, the output circuits 220 and 230 receive the output voltage from the single power supply circuit 25 and output the drive voltages based on the temperatures measured by the temperature measurement circuits 20 and 21, respectively. Hence, in the present embodiment, there is no need to change the configuration of the power supply circuit to be suitable for a desired lighting fixture each time.

Additionally, in the present embodiment, it is unnecessary to change the configuration of the power supply circuit 25 depending on a lighting fixture structure and a heat dissipation structure. Thus, the production cost can be reduced by shortening time necessary to design the device and using common parts.

In summary, according to the present embodiment, the production cost can be reduced, and it is unnecessary to change the configuration of the power supply circuit depending on a lighting fixture structure and a heat dissipation structure.

Alternatively, the output control circuit 24 of each of the aforementioned embodiments may control the output circuits 240 (220 and 230) by use of a data table shown in FIG. 11 instead of the data table shown in FIG. 3.

In this data table, until the digital value indicative of the detection voltage exceeds a first threshold, the control data set is "A0" irrespective of an amount of the digital value. The first threshold is corresponding to a first temperature. For example, the first threshold is 100. Note that, for example, the first temperature is determined in consideration of whether the plurality of regions 31 of the light sources 3 can be cooled properly even when the plurality of output circuits 240 has the same drive voltage.

In other words, until any of the temperatures measured by the temperature measurement circuits 20 and 21 exceeds the first temperature, the output control circuit 24 controls the output circuits 220 and 230 in such a way to output the same drive voltage. Accordingly, the control manner can be simplified. Further, the control data sets can share the same data and therefore a volume of data can be reduced and a production cost can be reduced. Furthermore, it is possible to store data for implementing another function in an available space of the memory obtained by reducing the volume of the data and therefore the performance can be improved.

While the digital value of the first detection voltage exceeds the first threshold, the value of the first control data set increases from "A1" to "A155" with an increase in the digital value of the first detection voltage. Further, while the digital value of the second detection voltage exceeds the first threshold, the value of the second control data set increases from "B1" to "B155" with an increase in the digital value of the second detection voltage.

In summary, while any of the temperatures measured by the temperature measurement circuits 20 and 21 exceeds the first temperature, the output control circuit 24 controls the output circuits 220 and 230 in such a way to output different drive voltages.

As described above, when determining that all the temperatures respectively measured by the plurality of temperature measurement circuits 210 are not greater than the first temperature (first threshold), the output control circuit 24 regulates the drive voltages of the plurality of output circuits 240 to a same voltage. In this case, when determining that at least one of the temperatures respectively measured by the plurality of temperature measurement circuits 210 is greater than the first temperature (first threshold), the output control circuit 24 may regulate the drive voltages of the plurality of output circuits 240 to different voltages.

In other words, the output control circuit 24 has a plurality of correspondence information pieces (the data tables in the present embodiment) each defining a correspondence relation between the temperatures and the drive voltages. The output control circuit 24 is configured to determine the drive voltages of the plurality of output circuits 240 based on the temperatures respectively measured by the plurality of temperature measurement circuits 210 by use of the plurality of correspondence information pieces. The plurality of correspondence information pieces have the same correspondence relation between the temperatures and the drive voltages in the range of equal to or less than the first temperature, and have different correspondence relations between the temperatures and the drive voltages in the range of more than the first temperature. Note that, the correspondence information piece may be the data table as described in the present embodiment or a function.

According to this arrangement, by decreasing the temperature of the light source 3 to avoid that the temperature of the light source 3 is kept high, it is possible to prevent a damage of the LED 30 due to the high temperature and to prolong the lifetime of the light source 3.

Further, the output control circuit 24 may control the output circuits 220 and 230 by use of a data table shown in FIG. 12 instead of the data table shown in FIG. 3.

In this data table, the first control data set ("TA0", . . . , "TA255") corresponding to the digital value of the first detection voltage and the second control data set ("TB0", . . . , "TB255") corresponding to the digital value of the second detection voltage are recorded.

Figure 13:
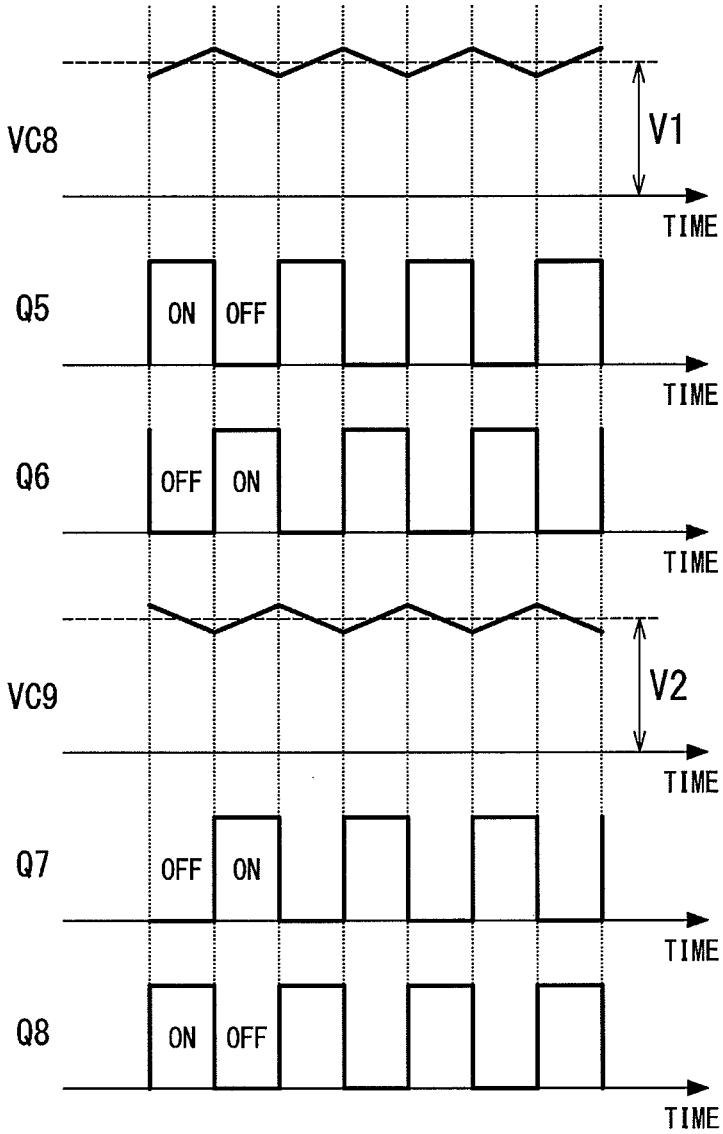
FIG. 13 is a waveform chart illustrating operation of each output circuit when the data table shown in FIG. 12 is used.

In this regard, the first control data set defines on-time and off-time of the switching device Q6, and the second control data set defines on-time and off-time of the switching device Q8. As shown in FIG. 13, the control data sets are determined such that a period in which the switching device Q6 is off does not overlap a period in which the switching device Q8 is off. For example, the off-time of the switching device Q6 determined by "TA0" of the first control data set does not overlap the off period of the switching device Q8 determined by any of the values of the second control data set.

Consequently, the switching device Q8 is kept turned on while the switching device Q6 is turned off, and therefore the output voltage of the power supply circuit 25 is supplied to only the first output circuit 220. Meanwhile, the switching device Q8 is kept turned off while the switching device Q6 is turned on, and therefore the output voltage of the power supply circuit 25 is supplied to only the second output circuit 230.

In brief, the output control circuit 24 controls the output circuits 220 and 230 to alternately receive the output voltage from the power supply circuit 25. In other words, the output control circuit 24 is configured to operate the plurality of output circuits 240 singly in order.

With this arrangement, in contrast to a configuration where the output voltage is supplied to the output circuits 220 and 230 simultaneously, the power supply circuit 25 can exert its potential as possible and the power supply circuit 25 can be downsized.

Further, it is preferable to provide a dimming circuit for dimming the light source 3 by regulating the output from the DC power source 1. The dimming circuit may be configured to, when any of temperatures measured by the temperature measurement circuits 20 and 21 exceeds the second temperature (greater than the first temperature), decrease the output from the DC voltage source 1. For example, the second temperature may be a permissible operation temperature (e.g., the maximum permissible operation temperature) of the LED 30.

In brief, the lighting device further includes the dimming circuit configured to dim the light source 3 by regulating power supplied from the power source 1 to the light source 3. The dimming circuit is configured to, when determining that at least one of the temperatures respectively measured by the plurality of temperature measurement circuits 210 exceeds the second temperature, decrease the power supplied from the power source 1 to the light sources 3.

The following explanation is made to an example in which the output control circuit 24 serves as the dimming circuit described above. Note that, this dimming circuit may be provided separately from the output control circuit 24.

When any of the digital values of the detection voltages exceeds a second threshold (corresponds to the second temperature and has, for example, a value of "200"), the CPU 24C of the output control circuit 24 reads out dimming control data from the memory 24D. Thereafter, the CPU 24C controls the DC power source 1 in such a way to decrease the output voltage of the DC power source 1 based on the dimming control data.

For example, the CPU 24C provides a dimming control signal to the switching device Q2 of the step-down chopper circuit 111, thereby decreasing the output voltage of the step-down chopper circuit 111 (i.e., the output voltage of the DC power source 1).

With this arrangement, when any of the regions 31 of the light source 3 has excessively high temperature, the light source 3 is dimmed such that the light output of the light source 3 is decreased. Therefore, it is possible to visually notify a user of occurrence of abnormality of the light source 3 through a change in the light output of the light source 3.

Note that, the dimming control data may be determined such that the light output is more decreased with an increase in the digital value of the detection voltage, or be determined such that the light output is kept at a constant dimming level. Additionally, when any of the digital values of the detection voltages exceeds the threshold for longer than a predetermined period, the output control circuit 24 may decrease the output voltage of the DC power source 1 more, or terminate the operation of the DC power source 1.

The following explanations referring to the drawings are made to examples of mounting the thermosensitive devices RX (RX1 and RX2) on the substrate 4 with regard to the aforementioned embodiments.

Figure 14:
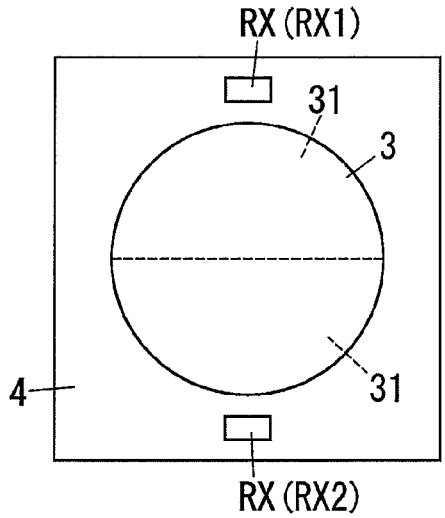
FIG. 14 is a diagram illustrating an example of arrangement of thermosensitive devices.
Figure 15:
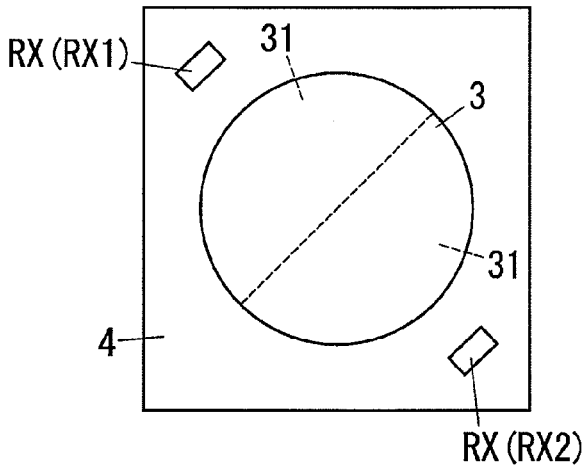
FIG. 15 is a diagram illustrating another example of the arrangement of the thermosensitive devices.

For example, as shown in FIG. 14, the thermosensitive devices RX1 and RX2 are mounted on the substrate 4 in such a manner to be arranged on the opposite sides of the light source 3, and as shown in FIG. 15, the thermosensitive devices RX1 and RX2 are mounted on the substrate 4 in such a manner to be arranged in a diagonal line of the substrate 4.

Figure 16:
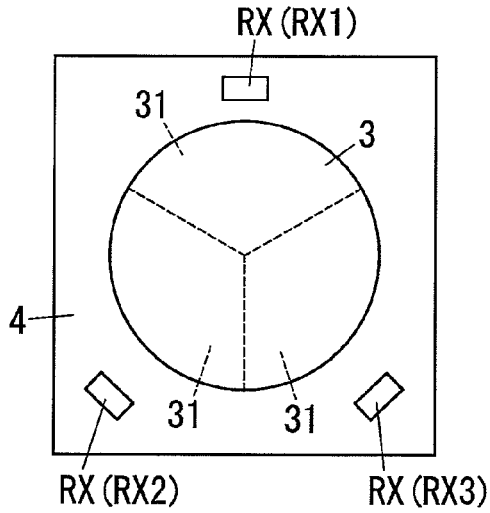
FIG. 16 is a diagram illustrating another example of the arrangement of the thermosensitive devices.

Alternatively, as shown in FIG. 16, three thermosensitive devices RX (RX1 to RX3) may be mounted on the substrate 4 in such a manner to be arranged in a vicinity of the light source 3. In this case, to provide a new set of a temperature measurement circuit, an output circuit, a fan motor, and a fan is necessary for the thermosensitive device RX3. This new set is not shown. In summary, in the example shown in FIG. 16, the cooling control circuit 2 is configured to control the three cooling devices 9 arranged to cool the three regions 31 of the light source 3 respectively.

Figure 17:
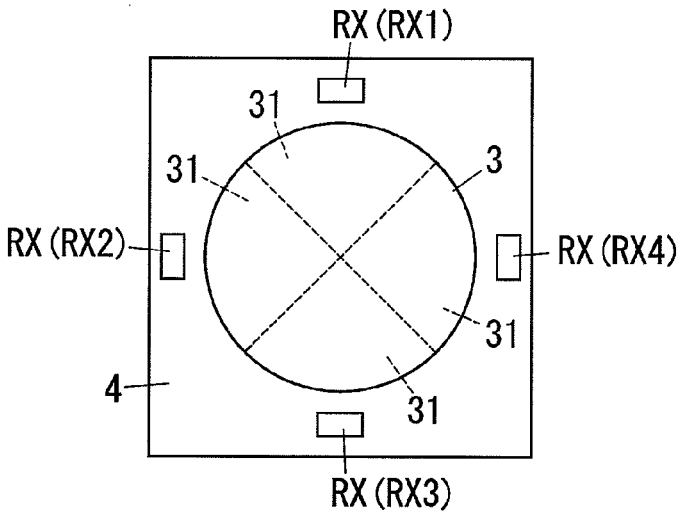
FIG. 17 is a diagram illustrating another example of the arrangement of the thermosensitive devices.

Alternatively, as shown in FIG. 17, four thermosensitive devices RX (RX1 to RX4) may be mounted on the substrate 4 in such a manner to be arranged in a vicinity of the light source 3. In this case, to provide a new set of a temperature measurement circuit, an output circuit, a fan motor, and a fan is necessary for each of the thermosensitive devices RX3 and RX4. These new sets are not shown. In summary, in the example shown in FIG. 17, the cooling control circuit 2 is configured to control the four cooling devices 9 arranged to cool the four regions 31 of the light source 3 respectively.

Note that, more than four thermosensitive devices RX may be mounted on the substrate 4 in such a manner to be arranged in the vicinity of the light source 3.

Note that, in the respective embodiments, the LED 30 is used as a solid state light emitting device used for the light source 3. Alternatively, the light source 3 may be constituted by another solid state light emitting device such as a semiconductor laser device and an organic EL device. Moreover, in the respective embodiments, a single light source 3 is employed. The number of light sources to be controlled is not limited to one but two or more light sources may be employed. When a plurality of light sources are employed, it is preferable that a plurality of temperature measurement circuits is used for each light source. Besides, it is not necessary for the light source 3 to include solid state light emitting devices, but it is sufficient that the light source 3 is designed to light up in response to energization.

Besides, the cooling device 9 may be a fan without a motor. For example, such a fan has an electromagnetic coil, a membrane, and a housing accommodating these, and generates an air flow by vibrating the membrane to discharge the air flow via a nozzle. The cooling device 9 is not limited to a fan but may be a thermoelectric device such as a Peltier device. For example, in a case where the cooling device 9 is a Peltier device, each of the output circuits 22 (220) and 23 (230) may be configured to supply a current to a drive circuit of the Peltier device.

As described above, in the lighting device of the present embodiment, the cooling control circuit 2 includes the power supply circuit 25 configured to receive the output voltage from the power source 1 and generate the power supply voltage that is to be supplied to the plurality of the output circuits 240. Until any of the temperatures measured by the temperature measurement circuits 210 exceeds the first temperature, the output control circuit 24 controls the output circuits 240 in such a way to output the same drive voltage. While any of the temperatures measured by the temperature measurement circuits 210 exceeds the first temperature, the output control circuit 24 controls the output circuits 240 in such a way to output different drive voltages.

Alternatively, the cooling control circuit 2 includes the power supply circuit 25 configured to receive the output voltage from the power source 1 and generate the power supply voltage that is to be supplied to the plurality of the output circuits 240. The output control circuit 24 controls the output circuits 240 to alternately receive the output voltage from the power supply circuit 25.

In summary, the lighting device of the present embodiment has the following eighth feature in addition to the first to seventh features. Besides, the second to seventh features are optional According to the eighth feature relying on any one of the first to seventh features, the cooling control circuit 2 further includes the power supply circuit 25 configured to output the constant voltage by use of power from the power source 1. The plurality of output circuits 240 each are configured to receive the constant voltage from the power supply circuit 25 as the power from the power source 1 and generate the drive voltage by use of the constant voltage.

Further, the lighting device of the present embodiment may have any one of the following ninth to eleventh features. Besides, the ninth to eleventh features are optional.

According to the ninth feature relying on the eighth feature, the output control circuit 24 is configured to, when determining that all the temperatures respectively measured by the plurality of temperature measurement circuits 210 are not greater than the first temperature, regulate the drive voltages of the plurality of output circuits 240 to a same voltage. The output control circuit 24 is configured to, when determining that at least one of the temperatures respectively measured by the plurality of temperature measurement circuits 210 is greater than the first temperature, regulate the drive voltages of the plurality of output circuits 240 to different voltages.

According to the tenth feature relying on the eighth feature, the output control circuit 24 has a plurality of correspondence information pieces each defining a correspondence relation between the temperatures and the drive voltages. The output control circuit 24 is configured to determine the drive voltages of the plurality of output circuits 240 based on the temperatures respectively measured by the plurality of temperature measurement circuits 210 by use of the plurality of correspondence information pieces. The plurality of correspondence information pieces have the same correspondence relation between the temperatures and the drive voltages in a range of equal to or less than the first temperature, and have different correspondence relations between the temperatures and the drive voltages in a range of more than the first temperature.

According to the eleventh feature relying on the eighth feature, the output control circuit 24 is configured to operate the plurality of output circuits 240 singly in order.

Furthermore, the lighting device of the present embodiment may have the following twelfth feature. Besides, the twelfth feature is optional.

According to the twelfth feature relying on any one of the first to eleventh features, the lighting device includes the dimming circuit (the output control circuit 24, in the present embodiment) for dimming the light source 3 by varying the output from the power source 1. The dimming circuit decreases the output from the power source 1 when acknowledging that any of the temperatures respectively measured by the temperature measurement circuits 210 exceeds the second temperature greater than the first temperature.

In other words, the lighting device further includes the dimming circuit configured to dim the light source 3 by regulating power supplied from the power source 1 to the light source 3. The dimming circuit is configured to, when determining that at least one of the temperatures respectively measured by the plurality of temperature measurement circuits 210 exceeds the second temperature, decrease the power supplied from the power source 1 to the light source 3.

Figure 18:
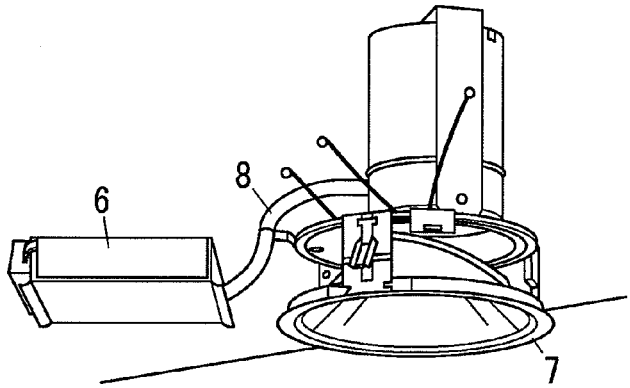
FIG. 18 is a schematic diagram illustrating an embodiment of a lighting fixture in accordance with the present invention.
Figure 19:
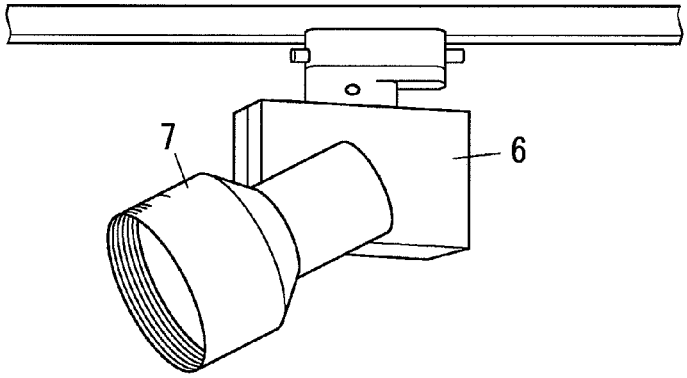
FIG. 19 is a schematic diagram illustrating another embodiment of the lighting fixture in accordance with the present invention.
Figure 20:
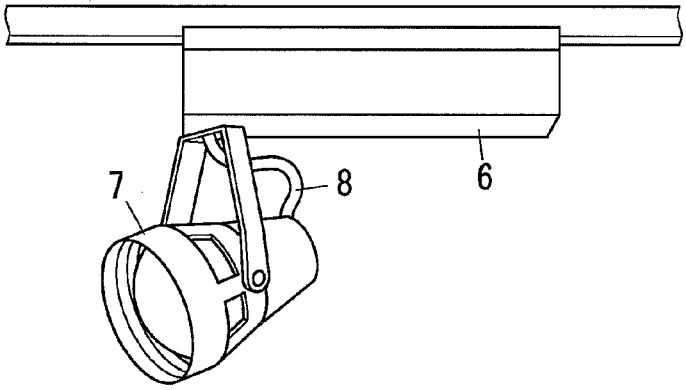
FIG. 20 is a schematic diagram illustrating another embodiment of a lighting fixture in accordance with the present invention.

The lighting device of any embodiment is available for lighting fixtures shown in FIGS. 18 to 20, for example.

Each of the lighting fixtures illustrated in FIGS. 18 to 20 includes a lighting device 6 corresponding to any one of the above embodiments, and a fixture body 7. The fixture body 7 is configured to hold the light source 3.

In these instances, it is preferable that the fans 5 (the cooling devices 9) and the thermosensitive devices RX of the lighting device 6 be positioned close to the light source 3. Hence, the fans 5 and the thermosensitive devices RX are held by the fixture body 7. Note that, the light source 3 and the thermosensitive devices RX are not shown in FIGS. 18 to 20.

In this regard, the lighting fixture shown in FIG. 18 is a down light, and the lighting fixtures shown in FIGS. 19 and 20 are spot lights. In the lighting fixtures shown in FIGS. 18 and 20, the lighting device 6 is connected to the light source 3 through a cable 8.

The lighting fixture of the present embodiment includes the lighting device 6 described above and the fixture body 7 for holding the light source 3.

In other words, the lighting fixture of the present embodiment includes the fixture body 7 for holding the light source 3, and the lighting device 6 having the aforementioned first feature, for controlling the light source 3. Note that, the lighting device 6 may have at least one of the aforementioned second to eleventh features, if needed.

With using the lighting device 6 of the embodiment described above, the lighting fixture of the present embodiment can produce the same effect as any one of the embodiments described above.

As described above, in the lighting fixture of the present embodiment, the temperatures of the respective regions 31 of the light source 3 are measured by the temperature measurement circuits 210, and the output control circuit 24 regulates the outputs of the cooling devices 9 based on the temperatures of the respective regions 31 of the light source 3. Hence, the lighting fixture of the present embodiment can cool the light source 3 such that the temperatures of the regions 31 are equal to optimal temperatures respectively. Accordingly, it is possible to reduce a difference in temperature in the light source 3. Furthermore, the lighting fixture of the present embodiment is different from the prior art in that the present embodiment does not require LEDs for providing power to cooling devices. Hence, there is no need to use LEDs able to withstand an increase in a forward current and therefore the production cost can be reduced.

Note that, the lighting fixture described above may be used alone but a plurality of lighting fixtures described above may be used to constitute a lighting system.

The invention claimed is:

1. A lighting device, comprising:

a power source configured to supply power to a light source having a plurality of regions;

a plurality of cooling devices arranged corresponding to the plurality of regions to cool the plurality of regions, respectively; and a cooling control circuit configured to control the plurality of cooling devices, wherein the cooling control circuit includes:

a plurality of output circuits configured to supply drive voltages to the plurality of cooling devices by use of power from the power source to drive the plurality of cooling devices, respectively;

a plurality of temperature measurement circuits configured to respectively measure temperatures of the plurality of regions; and an output control circuit configured to regulate the drive voltages respectively supplied from the plurality of output circuits based on the temperatures respectively measured by the plurality of temperature measurement circuits.

2. The lighting device as set forth in claim 1, wherein the output control circuit is configured to control the plurality of output circuits so as to reduce a difference between two temperatures selected from the temperatures respectively measured by the plurality of temperature measurement circuits.

3. The lighting device as set forth in claim 2, wherein the output control circuit is configured to control the output circuit corresponding to the temperature measurement circuit that has measured a higher one of the two temperatures.

4. The lighting device as set forth in claim 3, wherein:

each of the plurality of cooling devices is configured to increase a cooling capacity thereof with an increase in the drive voltage supplied thereto; and the output control circuit is configured to increase the drive voltage of the output circuit corresponding to the temperature measurement circuit that has measured the higher one of the two temperatures.

5. The lighting device as set forth in claim 1, wherein:

the cooling control circuit further includes a power supply circuit configured to output a constant voltage by use of power from the power source; and the plurality of output circuits each are configured to receive the constant voltage from the power supply circuit as the power from the power source and generate the drive voltage by use of the constant voltage.

6. The lighting device as set forth in claim 5, wherein the output control circuit is configured to, when determining that all the temperatures respectively measured by the plurality of temperature measurement circuits are not greater than a first temperature, regulate the drive voltages of the plurality of output circuits to a same voltage, and when determining that at least one of the temperatures respectively measured by the plurality of temperature measurement circuits is greater than the first temperature, regulate the drive voltages of the plurality of output circuits to different voltages.

7. The lighting device as set forth in claim 5, wherein:

the output control circuit has a plurality of correspondence information pieces each defining a correspondence relation between the temperatures and the drive voltages;

the output control circuit is configured to determine the drive voltages of the plurality of output circuits based on the temperatures respectively measured by the plurality of temperature measurement circuits by use of the plurality of correspondence information pieces; and the plurality of correspondence information pieces have the same correspondence relation between the temperatures and the drive voltages in a range of equal to or less than a first temperature, and have different correspondence relations between the temperatures and the drive voltages in a range of more than the first temperature.

8. The lighting device as set forth in claim 5, wherein the output control circuit is configured to operate the plurality of output circuits singly in order.

9. The lighting device as set forth in claim 1, further comprising a dimming circuit configured to dim the light source by regulating power supplied from the power source to the light source, wherein the dimming circuit is configured to, when determining that at least one of the temperatures respectively measured by the plurality of temperature measurement circuits exceeds a second temperature, decrease the power supplied from the power source to the light source.

10. The lighting device as set forth in claim 1, wherein each of the plurality of temperature measurement circuits includes a thermosensitive device having a characteristic value varying with a temperature.

11. The lighting device as set forth in claim 10, wherein the thermosensitive device is an NTC thermistor, a PTC thermistor, or a CTR thermistor.

12. The lighting device as set forth in claim 1, wherein the light source is configured to light up when energized.

13. A lighting fixture, comprising:

a fixture body for holding a light source; and a lighting device according to claim 1, for controlling the light source.

* * * * *